US009687727B2

(12) United States Patent
Scheper et al.

(10) Patent No.: US 9,687,727 B2
(45) Date of Patent: Jun. 27, 2017

(54) INTELLIGENT AUTOMATIC SHOE AND CARTRIDGE

(71) Applicant: Bally Gaming, Inc., Las Vegas, NV (US)

(72) Inventors: Paul K. Scheper, Bloomington, MN (US); Attila Grauzer, Las Vegas, NV (US); James V. Kelly, Las Vegas, NV (US); James B. Stasson, Chaska, MN (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 15/400,467

(22) Filed: Jan. 6, 2017

(65) Prior Publication Data

US 2017/0113126 A1 Apr. 27, 2017

Related U.S. Application Data

(63) Continuation of application No. 12/228,713, filed on Aug. 15, 2008, now Pat. No. 9,539,495.

(51) Int. Cl.
*A63F 13/00* (2014.01)
*A63F 1/00* (2006.01)
(Continued)

(52) U.S. Cl.
CPC ..... *A63F 1/00* (2013.01); *A63F 1/12* (2013.01); *A63F 1/14* (2013.01); *A63F 2009/2419* (2013.01)

(58) Field of Classification Search
None
See application file for complete search history.

(56) References Cited

U.S. PATENT DOCUMENTS 2,016,030 A 10/1935 Woodruff et al.
3,222,071 A 12/1965 Lang
(Continued)

FOREIGN PATENT DOCUMENTS

WO 0051076 A1 8/2000

OTHER PUBLICATIONS

International Search Report and the Written Opinion of the International Searching Authority for PCT Application No. PCT/US2009/053606; Dec. 3, 2009; 12 pages.
(Continued)

*Primary Examiner* — Jason Yen
(74) *Attorney, Agent, or Firm* — TraskBritt

(57) ABSTRACT

Card-reading shoes may include an input area configured to support cards therein. A card-reading system may be located within the card-reading shoe, the card-reading system including at least one sensor configured to detect at least a rank and suit of each card processed by the card-reading shoe. A toggle weight may be pivotally mounted proximate an output end of the shoe. The toggle weight may be configured to selectively rotate to enable cards to be removed from the card-reading shoe via the output end and to selectively remain stationary to prevent removed cards from being reinserted into the card-reading shoe via the output end. The card-reading shoes may optionally include a removable cartridge including a delivery end configured to enable manual removal of cards from the removable cartridge when the removable cartridge is removed from the input area.

20 Claims, 8 Drawing Sheets

(51) Int. Cl.

| | |
|---|---|
| *A63F 1/14* | (2006.01) |
| *A63F 1/12* | (2006.01) |
| *A63F 9/24* | (2006.01) |

(56) References Cited

U.S. PATENT DOCUMENTS

| | | | | |
|---|---|---|---|---|
| 3,929,339 | A | 12/1975 | Mattioli | |
| 4,171,737 | A | 10/1979 | McLaughlin | |
| 4,457,512 | A | 7/1984 | Stevenson | |
| 4,494,197 | A | 1/1985 | Troy et al. | |
| 4,534,562 | A | 8/1985 | Cuff et al. | |
| 4,667,959 | A | 5/1987 | Pfeiffer et al. | |
| 4,750,743 | A | 6/1988 | Nicoletti | |
| 4,755,941 | A | 7/1988 | Bacchi | |
| 4,830,375 | A | 5/1989 | Fleming | |
| 4,926,327 | A | 5/1990 | Sidley | |
| 4,995,615 | A | 2/1991 | Cheng | |
| 5,179,517 | A | 1/1993 | Sarbin et al. | |
| 5,209,476 | A | 5/1993 | Eiba | |
| 5,224,712 | A | 7/1993 | Laughlin et al. | |
| 5,257,179 | A | 10/1993 | DeMar | |
| 5,276,312 | A | 1/1994 | McCarthy | |
| 5,283,422 | A | 2/1994 | Storch et al. | |
| 5,356,145 | A | 10/1994 | Verschoor | |
| 5,362,053 | A | 11/1994 | Miller | |
| 5,374,061 | A | 12/1994 | Albrecht | |
| 5,470,079 | A | 11/1995 | LeStrange et al. | |
| 5,586,766 | A | 12/1996 | Forte et al. | |
| 5,586,936 | A | 12/1996 | Bennett et al. | |
| 5,605,334 | A | 2/1997 | McCrea, Jr. | |
| 5,613,912 | A | 3/1997 | Slater | |
| 5,655,961 | A | 8/1997 | Acres et al. | |
| 5,669,816 | A | 9/1997 | Garczynski et al. | |
| 5,681,039 | A | 10/1997 | Miller | |
| 5,683,085 | A | 11/1997 | Johnson et al. | |
| 5,722,893 | A | 3/1998 | Hill et al. | |
| 5,735,525 | A | 4/1998 | McCrea, Jr. | |
| 5,739,925 | A | 4/1998 | Kameyama et al. | |
| 5,772,505 | A | 6/1998 | Garczynski et al. | |
| 5,779,546 | A | 7/1998 | Meissner et al. | |
| 5,781,647 | A | 7/1998 | Fishbine et al. | |
| 5,788,574 | A | 8/1998 | Ornstein et al. | |
| 5,803,808 | A | 9/1998 | Strisower | |
| 5,911,626 | A | 6/1999 | McCrea, Jr. | |
| 5,919,090 | A | 7/1999 | Mothwurf | |
| 5,941,769 | A | 8/1999 | Order | |
| 5,989,122 | A | 11/1999 | Roblejo | |
| 6,039,650 | A | 3/2000 | Hill | |
| 6,071,190 | A | 6/2000 | Weiss et al. | |
| 6,093,103 | A | 7/2000 | McCrea, Jr. | |
| 6,117,012 | A | 9/2000 | McCrea, Jr. | |
| 6,126,166 | A | 10/2000 | Lorson et al. | |
| 6,149,154 | A | 11/2000 | Grauzer et al. | |
| 6,165,069 | A | 12/2000 | Sines et al. | |
| 6,217,447 | B1 | 4/2001 | Lofink et al. | |
| 6,250,632 | B1 | 6/2001 | Albrecht | |
| 6,254,096 | B1 * | 7/2001 | Grauzer | A63F 1/12 273/149 R |
| 6,267,248 | B1 | 7/2001 | Johnson et al. | |
| 6,267,671 | B1 | 7/2001 | Hogan | |
| 6,270,404 | B2 | 8/2001 | Sines et al. | |
| 6,293,864 | B1 | 9/2001 | Romero | |
| 6,299,536 | B1 | 10/2001 | Hill | |
| 6,313,871 | B1 | 11/2001 | Schubert | |
| 6,346,044 | B1 | 2/2002 | McCrea, Jr. | |
| 6,361,044 | B1 | 3/2002 | Block et al. | |
| 6,403,908 | B2 | 6/2002 | Stardust et al. | |
| 6,446,864 | B1 | 9/2002 | Kim et al. | |
| 6,460,848 | B1 | 10/2002 | Soltys et al. | |
| 6,517,435 | B2 | 2/2003 | Soltys et al. | |
| 6,517,436 | B2 | 2/2003 | Soltys et al. | |
| 6,520,857 | B2 | 2/2003 | Soltys et al. | |
| 6,527,271 | B2 | 3/2003 | Soltys et al. | |
| 6,530,836 | B2 | 3/2003 | Soltys et al. | |
| 6,530,837 | B2 | 3/2003 | Soltys et al. | |
| 6,532,297 | B1 | 3/2003 | Lindquist | |
| 6,533,276 | B2 | 3/2003 | Soltys et al. | |
| 6,533,662 | B2 | 3/2003 | Soltys et al. | |
| 6,579,180 | B2 | 6/2003 | Soltys et al. | |
| 6,579,181 | B2 | 6/2003 | Soltys et al. | |
| 6,582,230 | B1 | 6/2003 | Aoshima et al. | |
| 6,582,301 | B2 | 6/2003 | Hill | |
| 6,582,302 | B2 | 6/2003 | Romero | |
| 6,585,586 | B1 | 7/2003 | Romero | |
| 6,588,751 | B1 | 7/2003 | Grauzer et al. | |
| 6,595,857 | B2 | 7/2003 | Soltys et al. | |
| 6,616,535 | B1 | 9/2003 | Nishizaki et al. | |
| 6,622,185 | B1 | 9/2003 | Johnson et al. | |
| 6,629,889 | B2 | 10/2003 | Mothwurf | |
| 6,629,894 | B1 | 10/2003 | Purton | |
| 6,638,161 | B2 | 10/2003 | Soltys et al. | |
| 6,645,068 | B1 | 11/2003 | Kelly et al. | |
| 6,645,077 | B2 | 11/2003 | Rowe | |
| 6,652,379 | B2 | 11/2003 | Soltys et al. | |
| 6,663,490 | B2 | 12/2003 | Soltys et al. | |
| 6,666,768 | B1 | 12/2003 | Akers | |
| 6,685,567 | B2 | 2/2004 | Cockerille et al. | |
| 6,685,568 | B2 | 2/2004 | Soltys et al. | |
| 6,688,979 | B2 | 2/2004 | Soltys et al. | |
| 6,712,696 | B2 | 3/2004 | Soltys et al. | |
| 6,719,634 | B2 | 4/2004 | Mishina et al. | |
| 6,746,333 | B1 | 6/2004 | Onda et al. | |
| 6,758,751 | B2 | 7/2004 | Soltys et al. | |
| 6,758,757 | B2 | 7/2004 | Luciano, Jr. et al. | |
| 6,804,763 | B1 | 10/2004 | Stockdale et al. | |
| 7,264,241 | B2 | 9/2007 | Schubert et al. | |
| 7,374,170 | B2 | 5/2008 | Grauzer et al. | |
| 7,407,438 | B2 | 8/2008 | Schubert et al. | |
| 7,593,544 | B2 | 9/2009 | Downs et al. | |
| 7,699,694 | B2 * | 4/2010 | Hill | A63F 1/18 463/11 |
| 7,740,244 | B2 | 6/2010 | Ho | |
| 8,170,232 | B2 | 5/2012 | Kitahara et al. | |
| 8,490,973 | B2 | 7/2013 | Yoseloff et al. | |
| 8,844,931 | B2 | 9/2014 | Blaha et al. | |
| 2001/0036231 | A1 | 11/2001 | Easwar et al. | |
| 2001/0036866 | A1 | 11/2001 | Stockdale et al. | |
| 2002/0049909 | A1 | 4/2002 | Jackson et al. | |
| 2002/0068635 | A1 | 6/2002 | Hill | |
| 2002/0107067 | A1 | 8/2002 | McGlone et al. | |
| 2002/0113368 | A1 | 8/2002 | Hessing et al. | |
| 2002/0163125 | A1 * | 11/2002 | Grauzer | G10L 19/07 273/149 R |
| 2002/0187830 | A1 | 12/2002 | Stockdale et al. | |
| 2003/0084439 | A1 | 5/2003 | Perkins et al. | |
| 2003/0087694 | A1 | 5/2003 | Storch | |
| 2003/0151194 | A1 | 8/2003 | Hessing et al. | |
| 2004/0116179 | A1 | 6/2004 | Nicely et al. | |
| 2005/0051955 | A1 | 3/2005 | Schubert et al. | |
| 2005/0062227 | A1 | 3/2005 | Grauzer et al. | |
| 2005/0082750 | A1 | 4/2005 | Grauzer et al. | |
| 2005/0113166 | A1 | 5/2005 | Grauzer et al. | |
| 2005/0206077 | A1 | 9/2005 | Grauzer et al. | |
| 2005/0242500 | A1 | 11/2005 | Downs, III | |
| 2006/0033270 | A1 | 2/2006 | Grauzer et al. | |
| 2006/0279040 | A1 * | 12/2006 | Downs | A63F 1/14 273/149 R |
| 2007/0018389 | A1 | 1/2007 | Downs | |
| 2007/0138743 | A1 | 6/2007 | Fleckenstein | |
| 2007/0149280 | A1 | 6/2007 | LeMay et al. | |
| 2007/0210515 | A1 | 9/2007 | Schubert et al. | |
| 2007/0222147 | A1 | 9/2007 | Blaha et al. | |
| 2008/0006998 | A1 | 1/2008 | Grauzer et al. | |
| 2008/0018047 | A1 | 1/2008 | Schubert et al. | |
| 2008/0108426 | A1 | 5/2008 | Nguyen et al. | |
| 2008/0113700 | A1 | 5/2008 | Czyzewski et al. | |
| 2008/0301672 | A1 | 12/2008 | Rao et al. | |
| 2009/0283969 | A1 | 11/2009 | Tseng | |
| 2009/0289414 | A1 | 11/2009 | Bergman et al. | |
| 2010/0283202 | A1 | 11/2010 | Ho | |
| 2010/0314830 | A1 | 12/2010 | Grauzer et al. | |
| 2011/0031686 | A1 | 2/2011 | Tseng | |

(56) References Cited

U.S. PATENT DOCUMENTS

| | | | |
|---|---|---|---|
| 2011/0254222 | A1 | 10/2011 | Blaha et al. |
| 2012/0286471 | A1 | 11/2012 | Grauzer et al. |

OTHER PUBLICATIONS

Press Release for Alliance Gaming Corp., Jul. 26, 2004—Alliance Gaming Announces Contract With Galaxy Macau for New MindPlay Baccarat Table Technology, http://biz.yahoo.com/pmews.
Tracking the Tables, by Jack Bularsky, Casino Journal, May 2004, vol. 17, No. 5, pp. 44-47.

* cited by examiner

INTELLIGENT AUTOMATIC SHOE AND CARTRIDGE

CROSS-REFERENCE TO RELATED APPLICATION

This application is a continuation of U.S. patent application Ser. No. 12/228,713, filed Aug. 15, 2008, now U.S. Pat. No. 9,539,495, issued Jan. 10, 2017, the disclosure of which is hereby incorporated herein in its entirety by this reference.

TECHNICAL FIELD

The present invention relates to the field of gaming, the field of casino table card gaming, the play of card games delivered from playing card delivery shoes manually by a dealer, and the use of equipment with processing capability in the play of baccarat.

BACKGROUND

Many card games are popular throughout the world, with blackjack, baccarat, poker and poker variables being among the most popular wagering games. Examples of games that are easy to play but are difficult and costly to administer are blackjack and baccarat. In baccarat, one table is commonly attended by up to three casino personnel, regardless of the number of players. In addition, because the stakes are typically very high, credit managers and security personnel remain in close proximity to the table at all times. Casinos throughout the U.S. have baccarat tables, and many of these tables are high stakes tables. It is not unusual to observe players wagering large amounts in each round of play. Baccarat is a preferred game in Macau.

The game of baccarat is fairly simple to play from the player's perspective. The player is not given any opportunity to make decisions that would have an impact on the outcome of the game. The game is typically played with eight standard decks of 52 cards each, and the cards are typically shuffled and wrapped in the back end of the casino, out of the player's view. The cards are commonly destroyed or damaged by players during play, and it is typical for the casino to use the cards only once.

Baccarat has great appeal to gamblers. One rule of etiquette followed by certain players when playing baccarat is to never bet against the most elderly player at the table. If the most elderly player bets on the banker's hand, all other players at the table either bet on the same hand or they do not play. Betting against the most elderly player is viewed as being disrespectful to that player and bad luck.

The rules that the banker must follow in resolving hands in baccarat are fairly complicated, and the dealers can make errors, resulting in inadvertently overpaying players. In addition, the players handle cards, and the wagers are located in close proximity to the players' hands, making it easier for a player to slip in extra betting chips, for example, when the player's hand is particularly good, or remove chips when the player's hand is poor. Surveillance systems may not be in place, or may be inadequate to monitor all the activities taking place at the table.

Dealers might also collude with players, in order to cheat the house. Because the stakes are typically very high, any cheating and/or errors in operating the game can have a very large impact on the casino's revenue. For this reason, it would be desirable to have a system that could automatically monitor the play of baccarat, and have the capability of alerting the house to dealer errors, cheating and the like in real time.

Cards are ordinarily provided to players in casino table card games either directly from a deck held in the dealer's hand or with cards removed by the dealer from a dealing shoe, dealing rack or directly from a card shuffler. The original dealing racks were little more than trays that supported the deck(s) of cards and allowed the dealer to remove the front card (with its back facing up to hide the rank of the card) and deliver it to a player. Over the years, both stylistic and functional changes have been made to dealing shoes, which have been used for blackjack, baccarat, CASINO WAR®, mini-baccarat and other casino table card games.

The prior art describes a number of game play monitoring devices and systems that are used to monitor activity on a live gaming table. The following is a summary of known devices and systems.

U.S. Pat. No. 3,929,339 to Mattioli discloses a mechanical, manually driven card delivery shoe (without card-reading functionality) that uses a cartridge component for carrying shuffled playing cards to the card delivery shoe. The individual cards are advanced out of the shoe by means of feed rollers and the set of cards within the cartridge are advanced towards an output end within the shoe by weights moved along a rack and pinion gearing.

U.S. Pat. No. 4,750,743 to Nicoletti describes the use of a mechanical card-dispensing means to advance cards at least part way out of the shoe. The described invention is for a dispenser for playing cards comprising: a shoe adapted to contain a plurality of stacked playing cards, the playing cards including a leading card and a trailing card; the shoe including a back wall, first and second side walls, a front wall, a base, and an inclined floor extending from the back wall to proximate the front wall and adapted to support the playing cards; the floor being inclined downwardly from the back wall to the front wall; the front wall having an opening and otherwise being adapted to conceal the leading card; and the front wall, side walls, base and floor enclosing a slot positioned adjacent the floor, the slot being sized to permit a playing card to pass through the slot; card-advancing means contacting the trailing card and adapted to urge the stacked cards down the inclined floor; card-dispensing means positioned proximate the front wall and adapted to dispense a single card at a time, the card-dispensing means including leading card contact means adapted for rotation about an axis parallel to the leading card, whereby rotation of the leading card contact means displaces the leading card relative to the card stack and into a predetermined position extending out of the shoe from the slot; and an endless belt located in the opening in the front wall for rotating the leading card contact means, the endless belt having an exterior surface securely engaging the leading card contact means and being adapted to be displaced by an operator.

U.S. Pat. No. 5,779,546 to Meissner describes a method and apparatus to enable a game to be played based upon a plurality of cards. An automated dealing shoe dispenses each of the cards and recognizes each of the cards as each of the cards is dispensed. Player stations are also included. Each player station enables a player to enter a bet, request that a card be dispensed or not dispensed, and to convert each bet into a win or a loss based upon the cards that are dispensed by the automated dealing shoe. This patent discloses card readers for the play of blackjack.

U.S. Pat. No. 6,217,447 to Lofink et al. describes a method and system for generating displays related to the play of baccarat. Cards dealt to each of the banker's and player's hands are identified as scanning and data signals are generated. The card identification data signals are processed to determine the outcome of the hand. Displays in various formats to be used by bettors are created from the processed identification signals including the cards of the hand played, historical records of outcomes and the like. The display can also show bettors expected outcomes and historical bests. Bettors can refer to the display in making betting decisions.

U.S. Pat. Nos. 6,582,301; 6,299,536; 6,039,650; and U.S. Pat. No. 5,722,893 to Hill describe a shoe equipped with a card scanner that scans indicia on a playing card as the card moves along and out of a chute by manual direction by the dealer in the normal fashion. The scanner can be one of several different types of devices that will sense each card as it is moved downwardly and out of the shoe. A feed forward neural-network is trained, using error back-propagation to recognize all possible card suits and card values sensed by the scanner.

U.S. Pat. No. 6,126,166 to Lorson et al. describes a system for monitoring play of a card game between a dealer and one or more players at a playing table, comprising: (a) a card-dispensing shoe comprising one or more active card recognition sensors positioned to generate signals corresponding to transitions between substantially light background and dark pip areas as standard playing cards are dispensed from the card-dispensing shoe, without generating a bit-mapped image of each dispensed standard playing card; and (b) a signal processing subsystem. The subsystem may be adapted to: receive the transition signals generated by the active card recognition sensors; determine, in real time and based on the transition signals, playing card values for the dispensed standard playing cards; and determine, in real time, a current table statistical advantage/disadvantage relative to the players for playing cards remaining in the card-dispensing shoe.

U.S. Pat. No. 5,941,769 to Order describes a device for professional use in table games of chance with playing cards and gaming chips (jettons), in particular the game of "blackjack." An automatically working apparatus is provided, which will register and evaluate all phases of the run of the game automatically. This is achieved by a card shoe with an integrated device for recognition of the value of the drawn cards (optical recognition device and mirroring into a CCD-image converter); photodiodes arranged under the table cloth in order to register separately the casino light passing through each area for placing the gaming chips and areas for placing the playing cards in dependence of the arrangement or movement of the jettons and playing cards on the mentioned areas; a device for automatic recognition of each bet (scanner to register the color of the jettons, or an RFID-system comprising a S/R station and jettons with integrated transponder); an EDP program created in accordance with the gaming rules to evaluate and store all data transmitted from the functional devices to the computer; and a monitor to display the run of the game and players' wins.

Each of the references identified in the Background of the Art and the remainder of the specification, including any Related Application Data are incorporated herein by reference in their entirety as part of the enabling disclosure for such elements as apparatus, methods, hardware and software. It would be desirable to provide a system comprising software and hardware that could monitor the game of baccarat.

SUMMARY OF THE INVENTION

A playing card delivery shoe system for use in the play of casino table card games is disclosed. The system comprises: a) a removable cartridge for receiving a first set of shuffled playing cards useful in the play of the casino table card game, the cartridge having a back end and front card delivery end; b) an automated motor-driven playing card delivery shoe base having a cartridge receiving area; c) the card delivery shoe base having a pick-off roller that moves playing cards out of the front card delivery end of the cartridge; d) at least a first set of playing card rollers; e) an image capture system that captures image data of at least one of card value and card rank; f) a motor driving at least one set of rollers; g) a card delivery chute into which playing cards are moved one at a time by the rollers; and, h) a microprocessor that controls at least card movement and imaging functions. The image capture system includes a focal axis that is angled with respect to a line perpendicular with the face of the card. The output end of the shoe has a toggle weight to prevent reinsertion of cards. The output end in one embodiment has lighted areas to indicate game play status and dealer instructions. The cartridge is secured to the base by means of stabilizing elements. Software for operating the shoe may be downloaded from an external source.

DETAILED DESCRIPTION OF THE INVENTION

A playing card delivery shoe of the present invention is designed for use in the play of casino table card games, especially card games where cards are dealt to players and/or dealers one card at a time. The delivery shoe has at least the components of:

a) a playing card cartridge capable of holding playing cards (e.g., at least 52), and preferably 6-8 decks of playing cards;

b) a motorized card mover capable of moving cards one at a time out of the cartridge;

c) a playing card delivery chute having an opening for manual removal of cards from the chute; and d) an imaging system capable of reading at least card rank. Additional components or features in the card delivery shoe include a processor, a display panel, card reinsertion barrier in the chute, manual backup card ejection, extended angle of view in a card-imaging camera, player win, banker win, tie visual indicators at the output end and player hit and banker hit indicators.

Reference to the figures will assist in a fuller appreciation of the details of the present technology.

Figure 1:
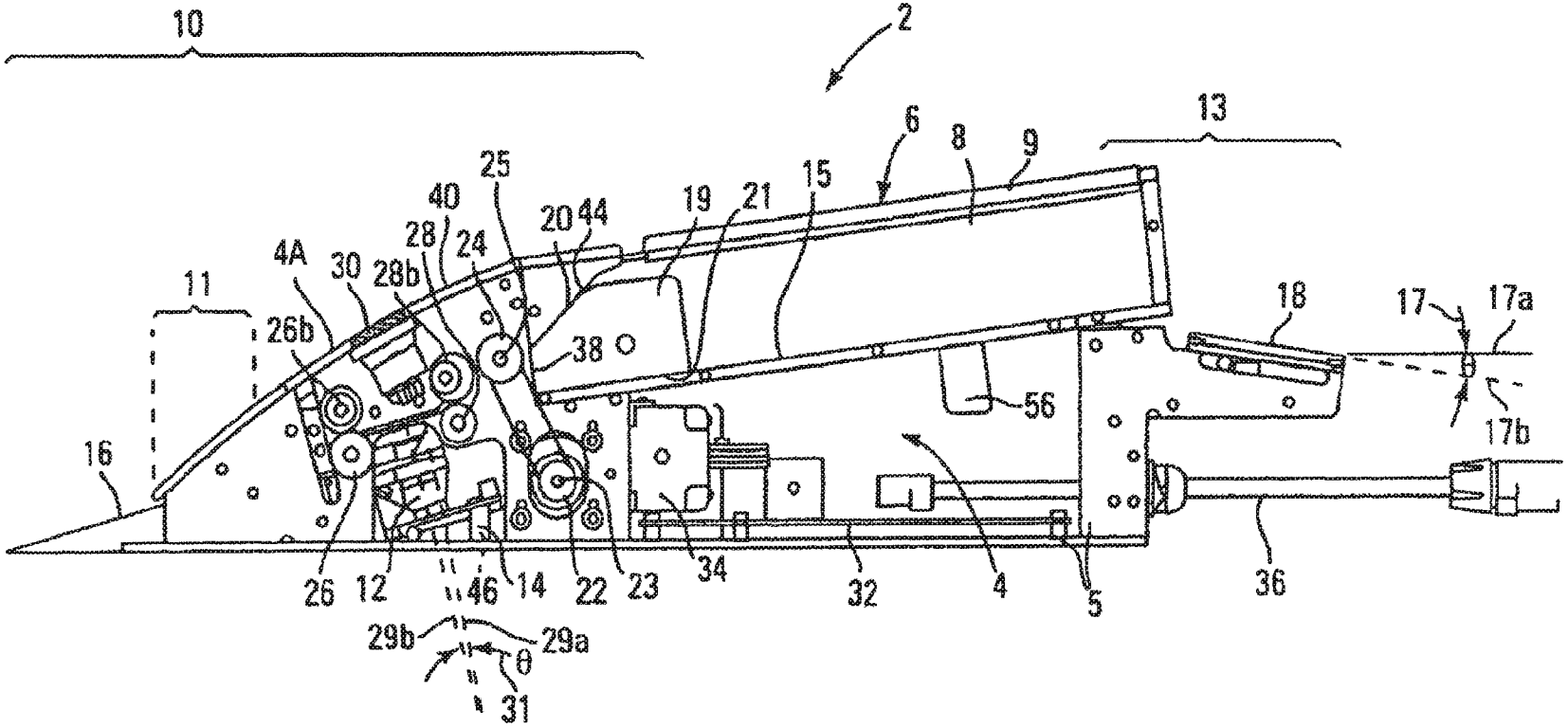
FIG. 1 is a left side elevational view of an automatic delivery shoe with a cartridge engaged therewith.
Figure 1A:
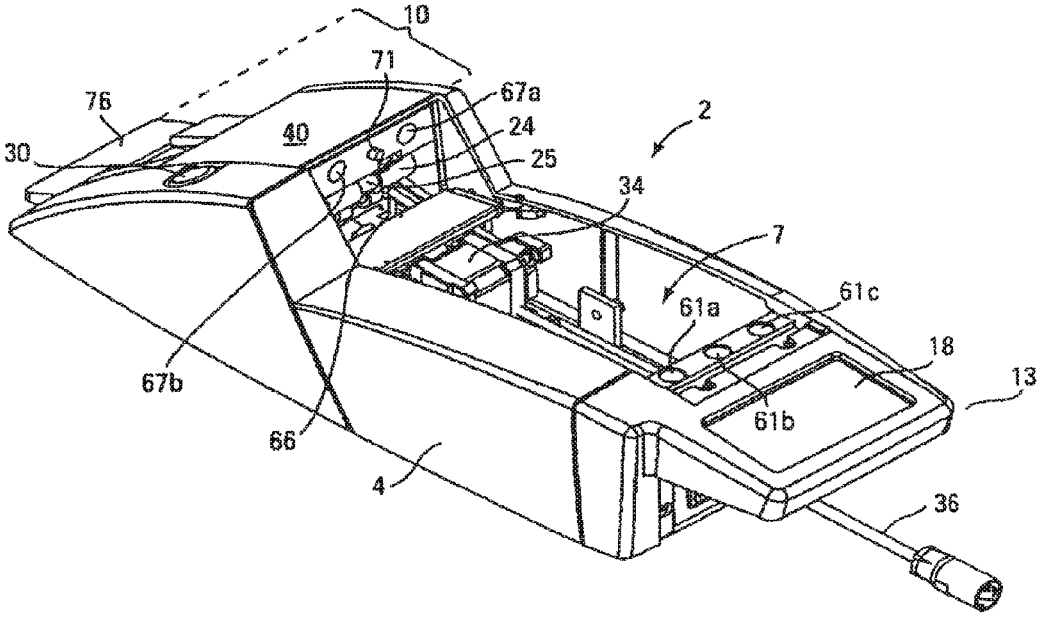
FIG. 1A is a perspective view of an automatic delivery shoe with the cartridge disengaged.

Referring to FIGS. 1 and 1A, an automatic delivery shoe system 2 of the present invention includes a base 4. The base 4 includes a card-moving end 10 and an opposite end or rear portion 13. Near the rear portion 13 is mounted an input and display panel 18. The base 4 also includes a frame 5 that supports a circuit board 32, a power supply 36, at least motors 34, 35 (shown in FIG. 2) and other system components that will be described in more detail, below. Roller 74 is also shown.

An imaging system 12 is provided for visually reading information off of playing cards (e.g., rank, suit, special indicia, and/or other readable information on playing cards). The imaging system 12 (e.g., camera, scanner, line arrays of imaging elements, CMOS, bar code reader, image capture device, or any other visual image recording system) is shown mounted on a support 14 that in one embodiment is stationary and in another embodiment can be adjusted or set (i.e., by means of pivoting) to establish a line of vision with respect to surfaces of playing cards moved through the delivery shoe 4A.

As shown in FIG. 1, the focal axis of the imaging system 12 is located along axis 29*b*, which is positioned at an angle θ 31 with respect to axis 29*a*. Axis 29*a* represents a focal axis that is perpendicular with respect to the card surface. Adjusting the focal angle 31 enables the imaging system to capture more information from the card. An exemplary angle 31 range is between 2° and 10° and in one embodiment, the selected angle is about 5°.

This angle in one embodiment is set at the factory and is not adjustable. In another embodiment, the support structure 14 of the imaging system 12 is adjustable in the field.

The ability of the imaging system 12 to be positioned at an angle with a focal line other than only perpendicular to cards moving through the delivery shoe 4A provides significant functional benefits. The delivery shoe systems 2 will not always be used with identical playing cards, and the images, codes, symbols, numbers, alphanumerics, bar codes and other information to be read on the cards will not be uniform in location or, in size and in color because card graphics vary between different manufacturers. In particular, the size of symbols on cards (e.g., the alphanumerics identifying rank, such as A, K, Q, J, 10, 9, 8, 7, 6, 5, 4, 3, and 2; and the symbols indicating suits ♠, ♣, ♥ and ♦) will not always be the same, and in some cases the sizes may be extremely large to assist in reading by visually impaired individuals or to display specialty cards. By shifting the angle of the image capture device away from a fixed perpendicular orientation with regard to playing cards moved through the delivery shoe 4A, the imaging system 12 has the ability to, or can be adjusted to have the ability to view greater surface area on passing cards. The support structure 14 (e.g., a post) may be adjusted by a simple screw 46 or threaded device (not shown) that elevates one end supporting the imaging device or by any other adjustable mechanism.

Also within the card-moving end 10 is a motor 34 that drives a pulley 22. Pulley 22 moves a belt 38 that turns card-moving rollers 24 mounted on a driven shaft 25. Rollers 24 remove cards one at a time from the cartridge 6.

The cartridge 6 of the present invention is provided for in the event of a power failure or a malfunction that would normally prevent the dealer from continuing play out of the same shoe. According to the invention, in the event of a malfunction, the cartridge can be removed from the shoe, and can be used without the base to continue play of the game (without card recognition, banker/player/tie win lights, etc.). The cartridge is configured such that cards can be manually removed from a front end of the cartridge without the shoe being docked into the base of the system 2. Some players and casino operators may want play to continue, despite a system malfunction or failure, and the present invention allows normal play to continue with one exception. In a preferred embodiment, there is typically a card positioned over the card-imaging system. If the system was not functioning, this card must be manually removed by using thumb wheel rollers (described below) and this card could be used in play or discarded, depending on the dealing procedures defined by the property.

Figure 3:
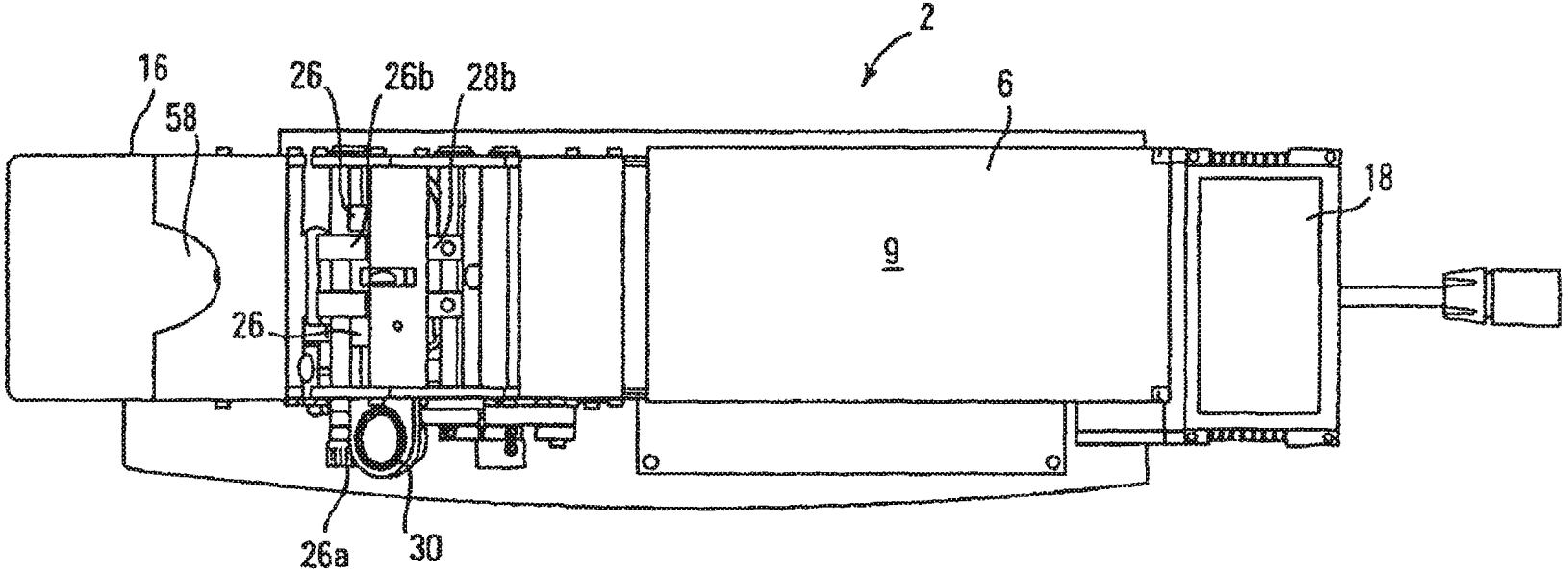
FIG. 3 is a top view of an automatic delivery shoe with a cassette engaged therewith and a display panel.

The card-moving rollers 24 may also be operated manually (e.g., thumb driven, digit driven) by either opening a panel 40 located above to manually turn rollers 24 or by having an extension (not shown) such as a crank or external thumb wheel mounted to drive shaft 23 or driven shaft 25 that can rotate the rollers 24 to move cards if the motor 34 loses power or any other dysfunction of the automated system occurs. Similarly, speed-up rollers 28, 28*b* and pinch rollers 26, 26*b* with driven rollers 26*b*, 28*b* are driven by motor 35 and move playing cards across a focal line of the imaging device 12. In one embodiment, the imaging system 12 is located between speed-up rollers 28, 28*b* and pinch rollers 26, 26*b*. In other embodiments, the imaging system 12 is located near the card delivery chute 11. If the speed-up roller system becomes dysfunctional, one or more of the speed-up rollers 28, 28*b* or pinch rollers 26, 26*b* may also be operated manually by opening panel 40 or by access with an external manually operable crank shaft or thumb wheel roller. The cards are moved by the speed-up rollers 28, 28*b* and pinch rollers 26, 26*b* into a delivery position near the output end 16 of the shoe. The cards are then manually removed one at a time through access area or finger slot 58, as shown in FIG. 3. Cards are preferably delivered one at a time and only single cards are fully available for manual removal. In alternate embodiments, one or multiple cards are delivered into a tray (not shown) and upon removal of the cards, the automatic delivery shoe system 2 delivers another one or more cards into the tray.

Also shown within FIG. 1 is the circuit board 32 that includes a processor and directs operation of the mechanical, electronic and electromechanical elements of the delivery shoe system 2. A power supply 36 is provided to supply power to the circuit board 32 and electronic devices, including motors, sensors, imaging system and the like.

Within the chamber 8 of the cartridge 6 is a rolling or sliding weight 19 that presses playing cards firmly against an angled front surface 44 of the cartridge to position the cards for removal by the card-moving rollers 24. The front end 20 of the weight 19 should be flush against the surface 44 when there are no playing cards present in the chamber 8. This arrangement assists in providing uniform pressure against playing cards and assists in their removal from the cartridge 6.

An activation button 30 is shown. This activation button 30 may be present and used to initiate a first card delivery after a new cartridge 6 has been inserted into the cartridge receiving area 7 of delivery shoe system 2.

Another element shown in FIG. 1 is the input and display panel 18. Information on the reading of playing cards, especially absence of specific cards, the presence of specific excess cards, game play outcomes, payouts and other features of interest to the dealer are shown. The angle of θ 17 of the display 18 with respect to the horizontal is such that only personnel behind the delivery shoe system 2 and overhead cameras (not shown, but as with the "eye-in-the-sky" cameras conventionally used in casinos) can read the information. In various embodiments, this angle is between about 5° and 20°. LED, plasma, liquid crystal, semiconductor or other display formats may be used. The processor that is incorporated into the circuit board 32 has programming that will provide at least some of the displayed information for the screen on the display 18.

Figure 2:
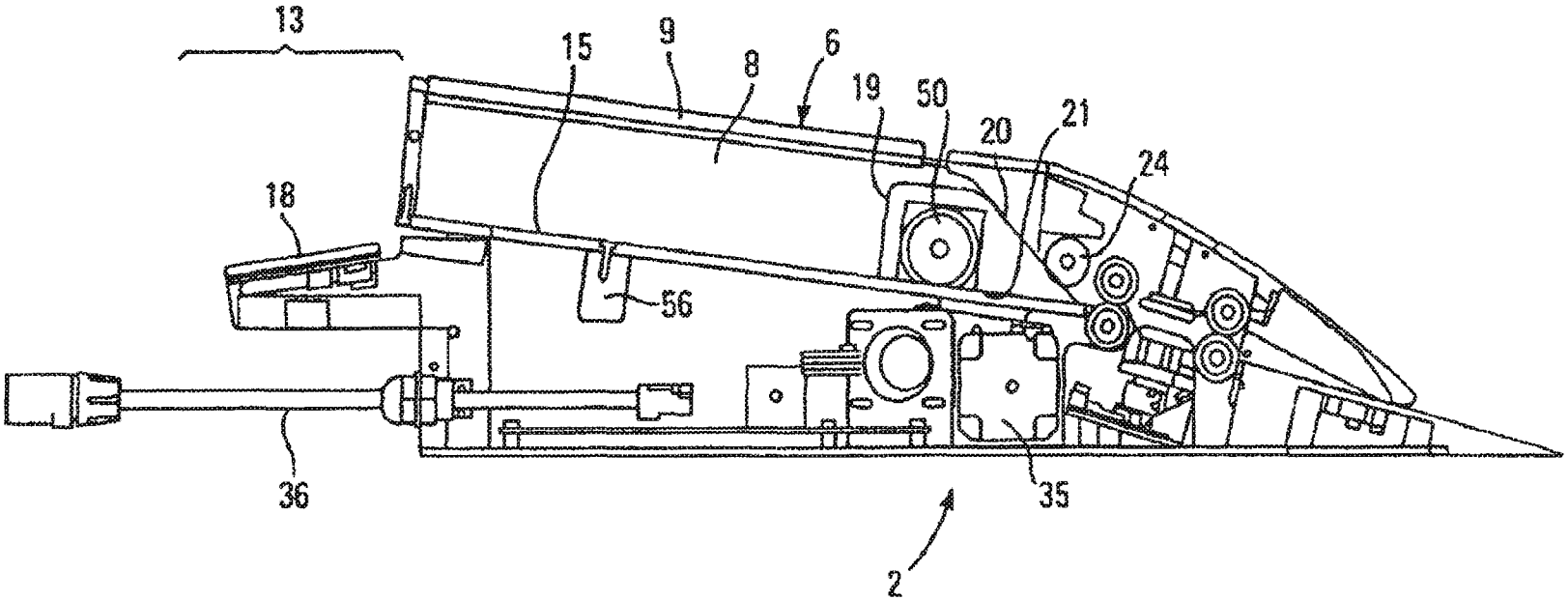
FIG. 2 is a right side elevational view of an automatic delivery shoe with a cartridge engaged therewith.

FIG. 2 is a side cross-sectional view of an automatic delivery shoe system 2 with a cartridge 6 engaged therewith. The cartridge 6 has a chamber 8 for retaining cards (not shown) and a removable lid 9 to make the cards accessible to the dealer. A rotating wheel 50 is shown on the bottom of the moving weight 19. The wheel 50 reduces friction between a lower surface 15 of the cartridge 6 and a lower surface 21 of the weight 19. Also, the ability of card-moving roller 24 to engage and contact cards (not shown) within the chamber 8 of the cartridge 6 is more clearly displayed.

FIG. 3 is a top plan view of an automatic delivery shoe system 2 with a cartridge 6 engaged therewith. The panel 40 (shown in FIG. 1A) has been removed to show a top view of interior elements, such as manual thumb wheel 26*a* for moving pinch rollers 26, 26*b*. A finger slot 58 in the output end 16 is also shown. On the display panel 18, there is either a touch screen data entry capability or alternatively, buttons (not shown) may be used for data entry.

Figure 4:
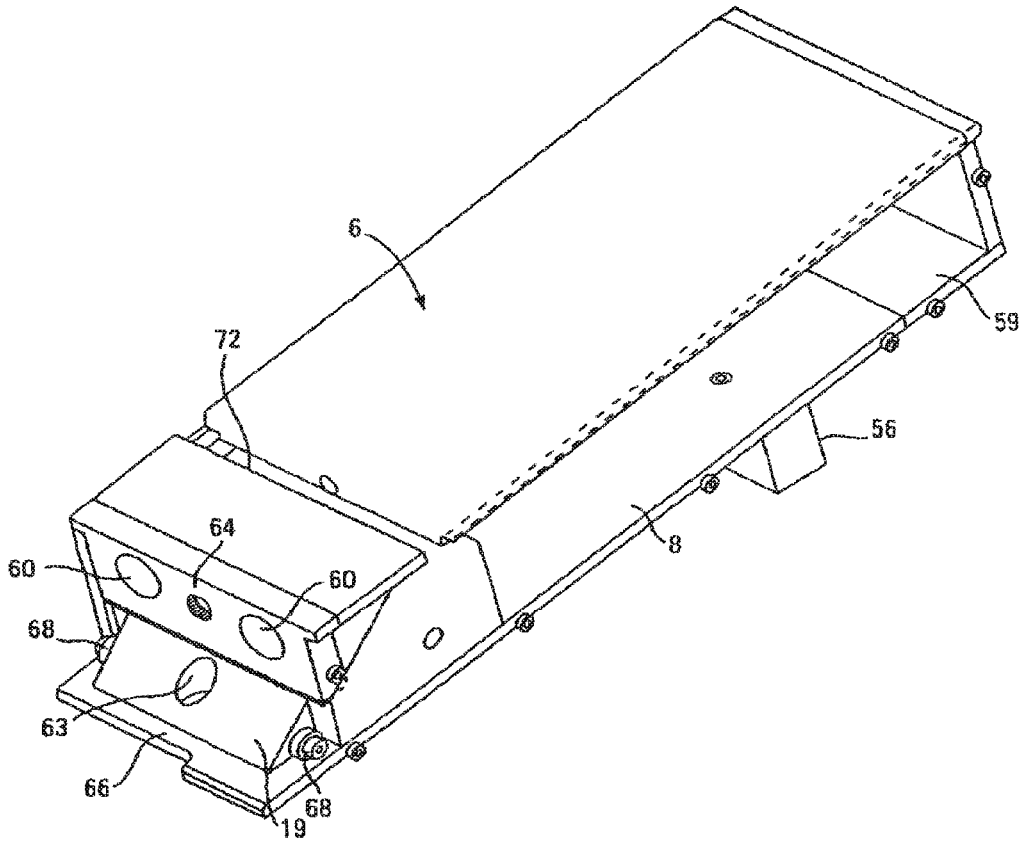
FIG. 4 is a perspective view of a cartridge with a side panel removed.

FIG. 4 is a perspective view of a cartridge 6 without playing cards in the chamber 8 and with the near side panel removed to reveal features of the cartridge. There are three position-stabilizing elements 60 and 64 shown. The two elements 60 are here shown as magnets that strongly grip onto opposing metal plates 67*a*, 67*b* (shown in FIG. 1A) or magnetically susceptible plate (not shown) to removably secure the cartridge 6 to the delivery shoe (not shown). The other stabilization element 64 shown is an opening that mates with the pin 71 in the delivery shoe base 4 and engages to position and secure the cartridge 6. The cartridge 6 includes a metallic portion 59 that mates with magnets 61*a*, 61*b*, 61*c* mounted to the rear portion 13 of the base 4 (shown in FIG. 1A). A card present sensor 66 (shown in FIG. 1A) aligns vertically with hole 63 of the sliding weight 19 to activate the imaging device 12. Rollers 68 are provided near the leading edge of the sliding weight 19 to further reduce friction and cause the sliding weight to glide. A stabilizing foot 56 is shown on the cartridge 6 that will vertically stabilize the cartridge when inserted into the cartridge receiving area 7 of base 4. When the cartridge is inserted into the base 4, the stabilizing elements, magnets and stabilizing foot 56 function to retain the cartridge 6, securely in the base 4.

Figure 5:
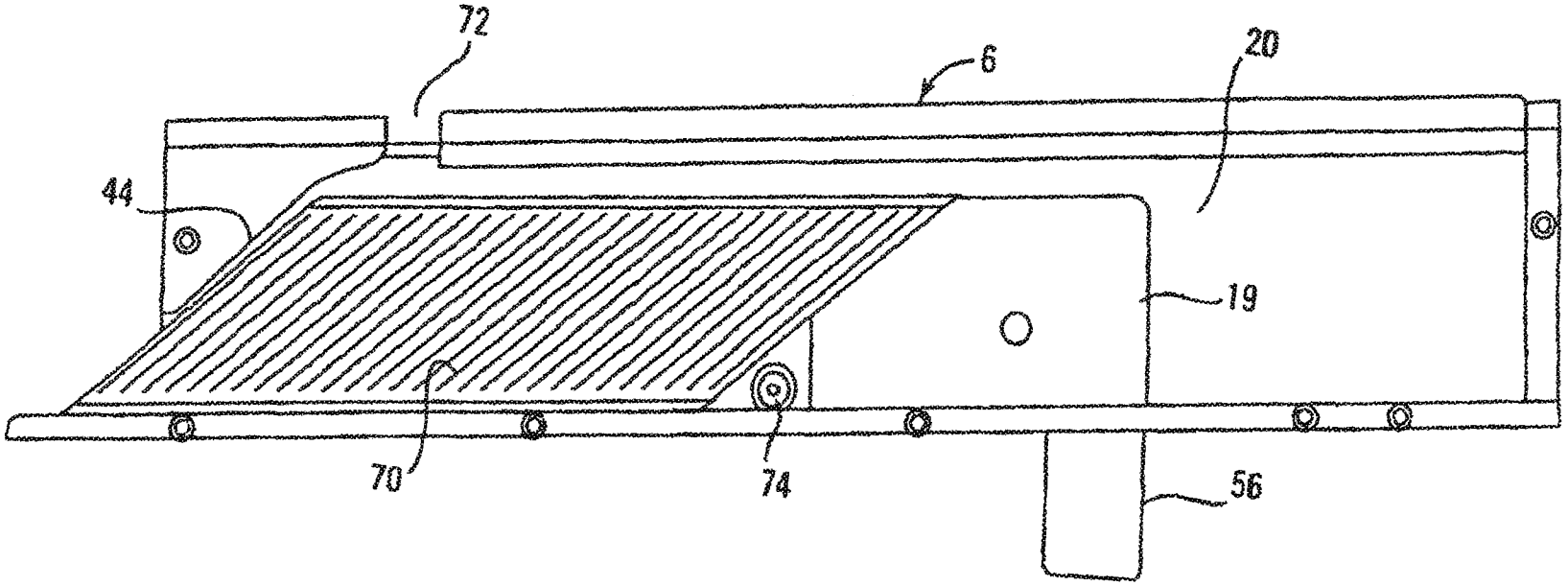
FIG. 5 is a side cutaway view of a cartridge containing playing cards for attachment to a delivery shoe of the present technology.

FIG. 5 is a side cutaway view of a cartridge 6 containing a group of playing cards 70 for attachment to a delivery shoe (not shown) of the present technology. A viewing slot 72 is provided to allow view of an upper edge of the cards 70 and to manually adjust cards 70 in the cartridge 6 if needed. Card delivery surface 76 is also shown.

Figure 6:
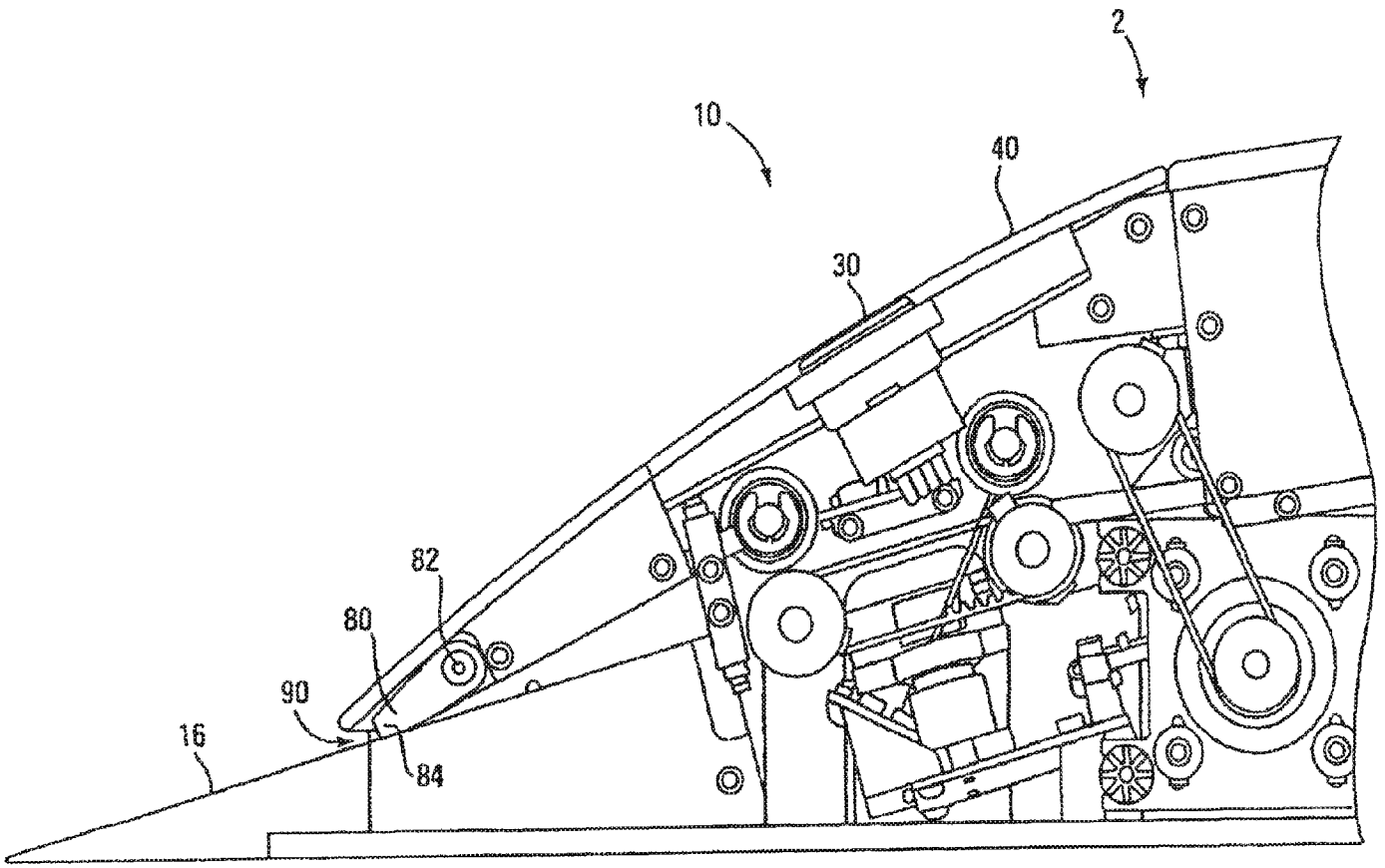
FIG. 6 is an enlarged side elevational view of the delivery end.

FIG. 6 shows a left side cutaway view of the front of the card-moving front 10 of a delivery shoe 2 within the scope of the present technology. In addition to repetitively showing other elements for alignment of FIG. 6 with FIGS. 1 through 3, at least the following noteworthy features are shown. A toggle weight 80 that pivots freely about axis pin 82 is shown at the front end of a playing card exit port. A front end 84 of the toggle weight 80 is shown here with a preferred construction with the front end 84 being blunt or flattened. The flattened front end 84 contacts an upper surface of the output end 16 and prevents any playing cards from being reinserted into the output end 16 of the delivery shoe system 2. Although a rounded or elliptical front end 84 functions as a check valve and would offer some resistance, the flat front end 84 prevents cards from easily leveraging against the toggle weight 80 to lift it and allow re-entry of playing cards. The toggle weight 80 also acts as a method of preventing the individual cards from slipping out on the playing surface and defining the stopping position for every card.

The processing board (e.g., circuit board 32) may communicate with an external PC. The external PC can be used to determine game outcome, to drive a game sign and to forward information to a back house computer system. The communication can take place via a standard serial port such as an RS 232 serial port or USB port. The processing board (e.g., circuit board 32 in FIG. 1) controls all aspects of the operation of the dealing or delivery shoe system 2. Examples of functions controlled by the board are dispensing cards, moving cards along a transport path by controlling motors and/or card feed rollers, moving cards from a card infeed into the transport path, and receiving signals from an external source such as a table game control system to control operation of the device. One exemplary processor board is manages the card recognition function has baccarat game logic and communicates to other devices through an Ethernet connection. Cards exit opening 90 at the delivery end 16.

The delivery shoe system 2 in one example of the invention has a digital display 18. The digital display 18 is capable of displaying information about the rank and/or suit of cards dealt, rounds dealt, cards remaining in the shoe, cumulative number of cards dealt, percentage of original cards used or remaining, hand composition, the player hit card, player hit rules, dealer hit rules, card jams, card movement, presence of the cut card, an indication to deal a hit card, the game outcome, historical game outcome and trends, the card count of the player and/or banker hands and any other information collected by the processor and/or external PC. Other functions of the display are described in more detail below. In one form of the invention, only information processed by the board is shown on the display. In another example of the invention, the display includes information from the external PC as well as the board.

Initially, pre-shuffled cards are loaded into the cartridge from the top. Cards are typically inserted when the cartridge is docked in the base, but the cards could also be loaded when the cartridge is separated from the base. After the cards are inserted, the removable lid 9 is placed over the cards. The order of the shuffled cards may or may not have been previously determined (for example, using a shuffling device that records the final order of the randomized set of cards, e.g., 1-8 decks of playing cards). If the final order is recorded, the order of cards delivered from the delivery shoe can then be compared with the order of cards as the cards are read prior to exiting the cartridge for further security. Both card order data sets can be compared on the fly or at the end of the completion of the cartridge delivery on external processor or other processing unit. Cards are scanned with an imaging system 12 such as a digital camera. In one embodiment, the rank and/or suit of each card is determined by the on-board processor in the shoe. In another embodiment, the digital output is fed directly to an external computer so that the rank information read from the cards can be extracted and used to determine the composition of the player and banker hands. In one example of the invention, the camera is connected to the external computer via a FireWire (IEEE1394). In other examples of the invention, the circuit board 32 processes the signal from the scanner. An example of a suitable camera and on-board processing system is described in U.S. Publication No. US 2007/0018389 assigned to Shuffle Master, Inc.

Information from the shoe may be date stamped and forwarded in real time through a port to a host computer, where the information can be further analyzed and stored. Since the suit of each card is irrelevant to the play of baccarat, preferably the software extracts only rank information in the play of that game. As individual playing card decks may differ at different facilities, each database and scanning system and interface may have to be initially trained with the various unique deck formats before the delivery shoe system is put into actual play on a casino floor. At each casino, this may have to be done only the first time the delivery shoe system is put into operation. One example of suitable machine vision software used to extract the rank (and/or suit) information is a type of machine vision API called eVision of 500 Park Blvd., Suite 525, Itasca, Ill. 60143.

The external PC or on-board processor may also be programmed with the rules of the game, such as baccarat, blackjack, or poker. A display panel 18 can be provided for displaying information relating to the rank of the cards and other information that relates to game rules. For example, in baccarat, the player hand must always take a hit card when the point count of the two-card hand is a five or below. After the processor has processed the player hand information and calculated the point count, it could also display an instruction for the dealer to deal a hit card. After the player hit card was scanned, the display could display this card along with the appropriate instruction for whether or not to deal a hit card to the banker hand. The display could also identify and display the winning hand. Any information displayed on the shoe display can additionally or alternatively be displayed on an external display device. In another embodiment, hit instructions and game outcomes may be displayed by means of lights with or without alphanumeric information near the output end of the shoe, as is described in more detail below.

Figure 7:
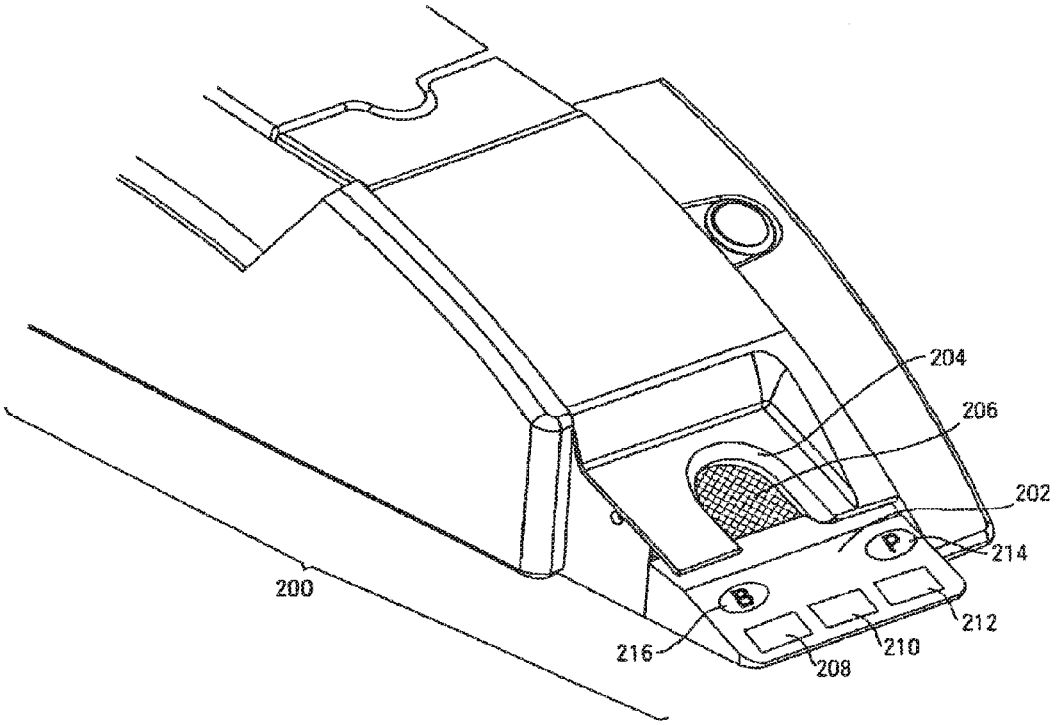
FIG. 7 shows a perspective view of an alternate card-moving end of a delivery shoe system of the present invention.

Another embodiment of the present invention is shown in FIG. 7. A perspective view of a card-moving end 200 of a delivery shoe system is shown. The card-moving end 200 includes a declining card support surface 202 and an ergonomic finger slot 204 for manually removing a card 206 delivered to the area defined by the finger slot 204. In one embodiment, a portion of the declining card support surface 202 is formed of a translucent material such as plastic, and is back lit with a series of lights with different functions. A first area 208 is illuminated when a banker hand wins. A second area 212 is illuminated when a player hand wins, and a third area 210 is illuminated when there is a banker-player tie. The illuminated areas are advantageously located at the delivery end of the machine, which is clearly visible to players, and eliminates the need for the dealer to take his eyes off the cards to look at the alphanumeric display on the opposite end of the shoe 4A.

Additional areas 214, 216 are provided to give a visual indication of a dealer instruction to deal an additional card to the player or banker hands. This feature allows a casino to use personnel who are less familiar with the game rules of baccarat, as it eliminates the need to memorize the tableau of hit/stand rules. Shuffle Master, Inc. has previously sold card-reading shoes that provide hit rules on a rear display, but only recommended in a dealer training mode. The delivery of cards out of shoe 4A occurs in area 211.

Preferably, the underside of the wedge defining the declining surface includes a number of recesses for receiving LED or other lamps. The lamps may be color coded, may provide user information in alphanumeric format, or may provide both types of user information.

Although the external-PC or on-board microprocessor may be programmed to determine game outcomes and otherwise provide the dealer with the necessary information to correctly administer the game, the system may also optionally be capable of sending time and/or date stamped data to a host computer for storage and/or later analysis. Examples of data that can be transferred to a host computer include player hand count, dealer hand count, value of the hit cards dealt, value of all cards dealt and game outcomes. If the gaming table includes a player identification/tracking system, this information can also be time/date stamped, uploaded and associated with the game information in order for the host computer to analyze playing habits of individual players, such as an amount of time spent on the table, for example, play trends, pit efficiency and the like. The system could also be used in connection with wagering monitoring devices in order to obtain betting habits of players. The method of data transfer can be via a standard network connection such as TCP/IP networking. Other networking methods such as Internet, Ethernet or wireless networking can also be used. The information transferred to a host computer may be encrypted and/or time delayed in order to secure the content of the transmission.

It is always possible for cards to jam, misalign or stick during internal movement of cards through the dealing shoe. There are a number of mechanisms that can be used to effect jam recovery. The jam recovery may be based upon an identified (sensed) position of jam, a sensed change in angular rotation of a shaft supporting card-moving rollers, changes in timing of sensed cards or may be an automated sequence of events. Where a card jam recovery is specifically identified by the sensed position of a jammed card in the device (and even the number of cards jammed may be estimated by the dimensions of the sensed image), a jam recovery procedure may be initiated at that specific location. The previously mentioned manual driven forces on cards can also assist in this regard.

If a card is sensed (e.g., by sensors) as jammed between rollers (e.g., a jam occurs when cards will not move out of the position between the rollers and cards refuse to be fed into that area), one of a various number of procedures may be initiated to recover or remove the jam. Among the various procedures that are discussed by way of non-limiting examples include at least the following. The rear-most set of rollers may reverse direction (e.g., opposed rollers turn clockwise and counterclockwise) to remove the jammed card from between the rollers and have the card extend backwards into the space, without attempting to reinsert a card into the chamber 8 of the delivery shoe system 2. The reversed rotation may be limited to assure that the card remains in contact with the rollers, so that the card can be moved back into progression through the dealing shoe. An optional part of this reversal can include allowing rollers to become free rolling to release contact and tension on the card during the reversal. The reversed rotation may be smoothly run or episodic, attempting to jerk a jammed card from its jam position. If that procedure does not work (or as an alternative procedure), both sets of rollers may reverse at the same time or in either sequence to attempt to free the jam of a card. When one set of rollers only is turning, it is likely to be desirable to have the other set of rollers in the area of the jam to become free rolling. It is also possible to have the rollers automatically spaced further apart (e.g., by separating roller pairs to increase the gap in the potential nip between rollers) to relieve tension on a card and to facilitate its recovery from a jam. The adjacent pairs of rollers can act in coordination, in sequence, in tandem, in order, independently or in any predefined manner. For example, the recovery process may have the rollers act as a first set at the same time in the same direction, a second set at the same time in the opposite direction to assist in straightening out cards, both sets have the rollers work sequentially, have the rollers work in a different sequence, have a first set operate for only an extended time, and then the second set operating alone or together with the first set, have only the second set operate for only an extended time or extended number of individual attempts and then the first set for a prescribed time, etc. As noted earlier, a non-active roller (one that is not attempting to drive or align cards) may become free-rolling during operation of another roller.

Individual playing cards may be imaged by multiple images in other embodiments of the present invention. The information may be imaged by either continuous reading of all image data or by triggered on/off imaging of data. For example, a card presence sensor may activate the reading sensor. This sensor is preferably a camera, such as a digital camera. A light source (not shown) may be provided to enhance the signal to the card-reading sensor or a digital camera may include the light source.

Information may be transferred from the card-reading elements (e.g., imaging system 12) from a communication port or wire (not shown) for sensor/reading element. A card or cards may be buffered or staged at various points within the dealing shoe 2, such as where restrained by rollers 26, 26*b*, 28, 28*b* so that cards partially extend towards the output end 16 past the rollers 26, 26*b*, or staged between rollers 24 and 28, 28*b* and the like.

The term camera is intended to have its broadest meaning to include any component that accepts radiation (including visible radiation, infrared, near ultraviolet, ultraviolet, etc.) and provides a signal based on variations of the radiation received. This can be an analog camera with a decoder or a digital camera or receiver that converts the received radiation into signals that can be analyzed with respect to image content. The signals may reflect either color or black-and-white information or merely measure shifts in color density and pattern. Area detectors, semiconductor converters, optical fiber transmitters to sensors or the like may be used. Any convenient software may be used that can convert to radiation signals to information that can identify the suit/rank of a card from the received signal. The term "camera" is not intended to be limited in the underlying nature of its function. Lenses may or may not be needed to focus light, mirrors may or may not be needed to direct light and additional radiation emitters (lights, bulbs, etc.) may or may not be needed to assure sufficient radiation intensity for imaging by the camera.

With regard to triggering of the camera, a triggering mechanism can be used to set the camera shot at an appropriate time when the card face is expected to be in the camera focal area. Such triggers can include one or more of the following, such as optical position sensors within an initial card set receiving area, an optical sensor, a nip pressure sensor (not specifically shown), but which could be within either nip roller and the like. Optical sensor 66 is provided in the preferred embodiment to trigger the imaging system 12. When one of these triggers is activated, the camera is instructed to time its shot to the time when the symbol containing corner of the card is expected to be positioned within the camera focal area. The card may be moving at this time and does not have to be stopped. The underlying function is to have some triggering in the device that will indicate with a sufficient degree of certainty when the symbol portion of a moving or moved card will be with the camera focal area. A light associated with the camera may also be triggered in tandem with the camera so as to extend the life of the light and reduce energy expenditure in the system. Non-triggering cameras such as a streaming video camera could also be used.

The system of the present invention is intended to increase dealer accuracy in providing the dealer with instructions on applying the rules of the card game being played, such as baccarat (i.e., when to give hit cards), and alternatively blackjack and poker. When combined with other table monitoring systems, the information gained can be even more valuable. For example, casinos wish to understand the play and wagering traits of their customers. Some casinos have employees visually observe customer's game play, manually tracking the gaming and wagering habits of the particular customers. The information allows the casinos to select the number of different games that the casino will provide and to adequately staff those games. The information also allows the casinos to select certain customers to receive complimentary benefits ("comps") and to determine the amount of comps a particular customer is to receive. The act of giving comps to a customer produces a large amount of goodwill with the customers, encouraging customer loyalty and further wagering. Some casinos have attempted to partially automate the tracking process, reading a customer "comp" card to identify the customer. The actual gaming and wagering patterns of the customers are visually observed by casino personnel and manually entered into a computer to create a digitized copy of the customer's gaming habits. The use of the lights at the output end increases security as the overhead cameras can image game results and prevents dealer-player collusion. This feature also assists in identifying training needs.

Similarly, casinos wish to track the efficiency of the casino and the casino's employees, as well as track betting and winning tendencies of individual players to avoid card counters or other play strategies that casinos consider to be undesirable. Such information allows the casino to make changes to identified situations and to increase the overall efficiency of the casino and of the employees, benefiting both the casino and customers. A typical method of tracking employee efficiency is to manually count the number of hands of a game dealt by a dealer over a time period. A change in an amount in a bank at the gaming table can also be manually determined and combined with the count of the number of hands to determine a win/loss percentage for the dealer. The casino can use the information to take appropriate action, such as rewarding an efficient dealer, or providing additional training to an inefficient dealer.

The fast pace and large sums of money make casinos regular targets for fraud, cheating and stealing. Casinos employ a variety of security measures to discourage cheating or stealing by both customers and employees. For example, surveillance cameras covering a gaming area or particular gaming table provide a live or taped video signal that security personnel can closely examine. Additionally, or alternatively, "pit managers" can visually monitor the live play of a game at the gaming table. The ability to track cards, track card play, track cards between a shuffling step (where the order of cards is identified by the shuffler through a reading function) and the dealing step (by reading cards in the dealing shoe) adds a further level of security to the casino and provides a clear basis of data for analysis by a central computer.

While some aspects of a casino's security system should be plainly visible as a deterrent, other aspects of the security should be unobtrusive to avoid detracting from the players' enjoyment of the game and to prevent cheaters and thieves from avoiding detection. The ability of a dealing shoe to read cards outside the view of players is a benefit to the secure environment without increasing the negative effects of players repeatedly seeing security devices.

The delivery shoe, its methods and apparatus may be generally defined as card delivery shoe having a storage end and a delivery end. The shoe stores a first set of cards in the storage end and allows manual removal of cards from the delivery end. There may be at least one first sensor in the delivery end that senses when a card is absent from the delivery end. The sensor provides a signal (to some intelligence or signal receiving function) and a signal or power is provided to a motor so that a card is delivered to the delivery end. A motor mechanically delivers a card to the delivery end of the shoe as a result of the initial sensing of the absence of any card from the delivery end, especially where the card may be manually removed from the delivery end. The card delivery shoe may also have at least one sensor that reads card values in the card delivery shoe before a card that is read is stationery in the card delivery end.

One way of describing one embodiment of the delivery shoe can be as a playing card delivery shoe that has a cartridge for receiving a first set of shuffled playing cards useful in the play of the casino table card game, the cartridge having a back end and front card delivery end. An automated motor-driven playing card delivery shoe has a cartridge receiving area. The card delivery shoe has a pick-off roller and may have one or more additional playing card movers (e.g., speed-up rollers) that move playing cards from the pick-off roller, past the imaging system and into the front end of the delivery shoe system 2. An image capture system captures image data of at least one of card value and card rank. A motor drives at least one of the sets of rollers. A card delivery chute receives playing cards one at a time from a set of rollers. The playing card delivery chute may contain a playing card reinsertion barrier. The reinsertion barrier has a front end and a pivotal axis, the front end being nearest a card removal position at an end of the chute. In a preferred mode, the front end is flat.

The image-capture system may be located between the pick-up rollers and the speed-up rollers. A display panel may be present on the delivery shoe and extend rearward of the cartridge. The playing card delivery system may have the image capture device with a focal axis that intersects playing cards between the pick-up rollers and the speed-up rollers at a focal angle that increases an angle of vision as compared to an axis perpendicular to the plane of a playing card at 90°, such as at an angle of between 2° and 10°. There may be a communication link between the playing card-imaging system and a processor, which processor analyzes data from the imaging system to rules of play of the casino table card game and determines results of play for a round of play of the casino table card game based upon the data. The processor may be internal to the device or external to the device.

One exemplary playing card delivery system has a manually operable thumb-wheel roller that is accessible outside of the playing card delivery system that can move cards out of the chute without assistance of the motor.

A method of the present invention provides a card to a dealer for manual delivery of the cards by a dealer, the method comprising:

- placing a shuffled set of cards within a card-holding cartridge, the card-holding cartridge having a card infeed area;
- inserting the card-holding cartridge into a cartridge-receiving compartment of a shoe;
- automatically moving playing cards on demand from the set of playing cards from the card infeed area past a card-reading sensor;
- the sensor reading individual cards for at least one of rank and suit as cards are moved past the card-reading sensor.

The above structures, materials and physical arrangements are exemplary and are not intended to be limiting. Angles and positions in the displayed designs and figures may be varied according to the design and skill of the artisan. Travel paths of the cards need not be precisely horizontal from the card input area to the delivery area of the shoe, but may be slightly angled upwardly, downwardly or varied across the path from the card input area to the card delivery area. The cards may be sensed and/or read within the shoe while they are moving or when they are still at a particular location within the shoe.

The shoe for use with the baccarat game may be integrated with other components, subcomponents and systems that exist on casino tables for use with casino table games and card games. Such elements as bet sensors, progressive jackpot meters, play analysis systems, wagering analysis systems, player comping systems, player movement analysis systems, security systems, round counting systems and the like may be provided in combination with the baccarat shoe and system described herein. Newer formats for providing the electronics and components may be combined with the baccarat system. For example, new electronic systems used on tables that provide localized intelligence to enable local components to function without absolute command by a central computer are desirable.

Software Process

Appropriate software is preprogrammed into the card-handling device to support at least the following functions:

Initial Setup

Depending on gaming jurisdiction requirements, the card-handling device may be shipped to the user with the operating software uninstalled. For those jurisdictions, a memory device containing the software will be shipped separately to a local technician or gaming authority for installation into the card-handling device. In this event, upon powering up the card-handling device the user will be prompted by the display screen to install the software. Operating software in one example of the invention consists of all code to operate the physical devices, such as sensors, control board, motors, imaging system, and the like. In one example of the invention, the game rules of baccarat are also stored on a memory device and installed in the field.

For other jurisdictions that allow suppliers to ship associated gaming equipment with software loaded, the software is loaded in the factory. Regardless of where the software is loaded, upon powering up the card-handling device, the user is prompted to load cards and push the green "start" button to begin play, if the device is empty, or remove cards from the feeder, if cards are present.

A method of loading software into a card-reading shoe may include:

- providing a card-reading shoe with an internal processor for controlling at least card-reading functions, a display and an external data port;
- providing computer code on a storage media;
- energizing the card-reading shoe, wherein instructions to load software appear on the display; and
- loading the computer code through the external data port.

The computer code may be provided on a memory stick. A SHA-1 hash value may be displayed, and the hash value may be compared to a provided hash value to verify the authenticity of the computer code. An assigned unique source code may be displayed and compared to verify the authenticity of the computer code.

The initial setup for the device is accessible through a "Main Menu" button (not shown) on the display screen 18 to select options for the game desired. Preferably, the Main Menu contains sub-menus, such as, "Set Up," "Games," "Cards," "Data" and "Service."

To validate the software, a known secure hashing algorithm, such as SHA-1, will be provided to the gaming authority. Preferably, the SHA-1 produces a 40 character bit stream when the software is sampled. In one embodiment, as an additional security precaution, a unique source code will also be provided to the local technician or gaming authority to authenticate the 40 character bit stream.

The user may select the "Set Up" sub-menu (not shown) to select items such as the date, time, and access to device history. Preferably, the Set Up sub-menu allows the user to select Network options to allow the device to communicate with an external stand-alone computer or back-house computer system.

The "Games" sub-menu (not shown) allows the user to select any of a plurality of preprogrammed games, such as blackjack, CASINO WAR®, and baccarat. Additionally, this sub-menu allows the user to select the desired number of decks of cards for the selected game, such as 2, 4, 6, 8, etc. In some examples of the invention, the rules of the selected game are programmed into the shoe's on-board computer memory. In other examples, the rules are contained in computer external to the shoe. Typically games with more complex rules such as blackjack require a more robust external computer, while games with simpler rules such as baccarat and CASINO WAR® have the rules programmed into the shoe's internal computer.

The user can also select "Deck Inventory" from the menu on the display panel 18. This selection will allow the verification of the completeness of the decks. All the cards will have to be drawn one at a time in this case. Once the draw is complete, the completeness of the shoe (one or more decks) is displayed on the associated display panel 18.

The "Cards" sub-menu allows the user to select the type of playing cards, which will be used in the device from the Deck Library. The Deck Library is a preprogrammed assortment of known playing cards, of different styles, from a plurality of manufacturers. By selecting a particular brand of cards, the card recognition system will recognize the type of cards which will be used in the device. In this manner, the device is taught which region of the playing card to scan and associates the scan with the known library for that particular manufacturer's playing cards. The system may also recognize different characters, colors, shapes and fonts after the desired card selection is made. Because the data sets corresponding to different types of cards is large, only the most commonly used card information is pre-programmed into the device. Data for additional types of playing cards may also be downloaded from a master deck library maintained by Shuffle Master, Inc., the assignee of the present application, to the device via an Internet connection.

The "Data" sub-menu allows the user to view how many total cycles the device has preformed, how many good cycles vs. failed cycles and other game information. The "Service" sub-menu is provided for prompting the user to perform functions such as updating versions of installed software, and routine cleaning. This menu may also provide diagnostics and troubleshooting information.

Start Up and Play

Once the card-handling device has been set up for use, including game, card and deck selection, the device may then be used in the play of a casino game. The device will prompt the user to either load cards or clear the feeder before beginning a round of play. The feeder is typically automatically cleared by the transport rollers. The cards in the cartridge are removed manually. After the cards are loaded and the green button is pushed, the first card is delivered to the front of the shoe and a dealer may begin a round of play. A card sensor indicates the absence of a playing card within the front of the shoe, which sends a signal to the processor. The process software then triggers the card-moving rollers 24, 28, **28*b* to pick off the top card and transport the card through the card-reading area. In the card-reading area, at least a region of the playing card is scanned with a CMOS imaging system to identify at least the card rank and suit of the playing card. After the image is scanned, the process software triggers the pinch rollers 26, 26*b* to propel the playing card into the card delivery area 10 and into the chute 11** to be manually dealt by the dealer.

In one embodiment of the invention, the card-handling device is a component to an electronic gaming table system. In this embodiment, the card rank and suit information is sent to a game controller external to the shoe which is loaded with the game rules. The controller then tracks the card rank and suit information as cards are dealt to players in order to determine player hand composition. This information may be used to verify winning hands.

The CMOS imaging system produces a signal corresponding to the sensed image on the card. The CMOS imaging system preferably outputs the signal as gray scale data. This system further comprises a FPGA capable of converting the signal provided by the CMOS imaging sensor from gray scale data into binary data, and further processes the binary data into acquired vectors. The acquired vectors are compared with a library of vector templates via a matching algorithm, wherein each vector template represents at least one of the rank or suit of the card. Once known vectors are matched with the acquired vectors, the card has been "recognized." The rank and suit of the card may then be communicated to the card-handling device or external network, which is displayed, typically on an electronic display, as an alphanumeric image or as a graphical representation of the card from the associated library of graphical data files.

In the preferred embodiment, the card-handling device may stand alone, loaded with game rules and card recognition technology, with an optional network connection to a back-house computer system or other network device. In the networked embodiment, card rank and suit information is displayed as a graphical representation of the captured image on the device display screen, preferably, as an alphanumeric representation, as an icon or as a graphical representation of a card face. The card rank and suit information may also be communicated to a larger player or pit display.

The process software further provides an alarm, preferably audible or displayed as an error message on the device display screen, to indicate card jams or other malfunctions.

The alarm in one embodiment is audible and is used to signal the delivery of each card from the shoe, signal any overdraw condition, etc. (not only an error message alarm).

What is claimed is:

1. A card-reading shoe, comprising:

an input area configured to support cards therein;

a card-reading system within the card-reading shoe, the card-reading system comprising at least one sensor configured to detect at least a rank and suit of each card passing through the card-reading shoe; and a toggle weight pivotally mounted proximate an output end of the shoe, the toggle weight being configured to selectively rotate to enable cards to be removed from the card-reading shoe via the output end and to selectively remain stationary to prevent removed cards from being reinserted into the card-reading shoe via the output end.

2. The card-reading shoe of claim 1, wherein the toggle weight comprises an elongated member having a first end mounted pivotally to a frame of the shoe and a second, opposite end shaped and positioned to block reentry of cards into the card-reading shoe via the output end.

3. The card-reading shoe of claim 2, wherein the second, opposite end is at least substantially flat.

4. The card-reading shoe of claim 3, wherein the first end of the elongated member is located proximate an upper surface of the output end and the second, opposite contacts a lower surface of the output end when the toggle weight is positioned to prevent removed cards from being reinserted into the card-reading shoe via the output end.

5. The card-reading shoe of claim 2, wherein the second, opposite end is located proximate an exit port of the output end, the exit port sized and shaped to permit one or more cards at a time to exit the output end.

6. The card-reading shoe of claim 2, wherein the elongated member is configured to pivot freely about an axis pin pivotally mounting the elongated member to the frame.

7. The card-reading shoe of claim 1, further comprising a removable cartridge sized and shaped to receive a set of shuffled playing cards, the removable cartridge sized to be received within the input area of the shoe, the removable cartridge comprising a delivery end configured to enable manual removal of cards from the removable cartridge when the removable cartridge is removed from the input area.

8. The card-reading shoe of claim 7, wherein the removable cartridge comprises a movable weight configured to urge cards within a chamber of the removable cartridge toward an angled surface at an end of the removable cartridge.

9. The card-reading shoe of claim 8, wherein a finger slot is located in the angled surface of the removable cartridge.

10. The card-reading shoe of claim 7, further comprising card rollers located proximate the card-reading system, the card rollers configured to enable removal of a card from within the card-reading shoe when the removable cartridge is removed from the input area.

11. The card-reading shoe of claim 10, wherein the card rollers are manually operable.

12. The card-reading shoe of claim 7, wherein the removable cartridge comprises a plurality of position-stabilizing elements configured to maintain the removable cartridge at a predetermined orientation within the input area and to enable selective removal of the removable cartridge from the input area.

13. The card-reading shoe of claim 12, wherein the position-stabilizing elements comprise magnets and a receptacle configured to mate with corresponding ferromagnetic elements and a pin in the input area.

14. A method of operating a card-reading shoe, comprising:

supporting cards in an input area of the card-reading shoe;

detecting at least a rank and suit of each card passing through the card-reading shoe utilizing at least one sensor of a card-reading system within the card-reading shoe;

removing cards from the card-reading shoe via an output end of the card-reading shoe by moving the cards past a toggle weight pivotally mounted proximate an output end of the shoe; and preventing cards from being reinserted into the card-reading shoe via the output end utilizing the toggle weight.

15. The method of claim 14, wherein preventing the cards from being reinserted into the card-reading shoe via the output end utilizing the toggle weight comprises contacting an at least substantially flat surface of the toggle weight against a lower surface of the output end.

16. The method of claim 15, wherein removing the cards from the card-reading shoe via the output end comprises causing the toggle weight to pivot freely about an axis pin pivotally mounting the toggle weight to a frame of the output end.

17. The method of claim 14, wherein supporting the cards in the input area of the card-reading shoe comprises positioning a removable cartridge containing a set of shuffled playing cards within the input area of the shoe.

18. The method of claim 17, further comprising removing the removable cartridge from the input area and manually removing cards from the removable cartridge one at a time via a delivery end of the removable cartridge.

19. The method of claim 18, further comprising removing a card from within the card-reading shoe after removing the removable cartridge from the input area utilizing card rollers located proximate the card-reading system.

20. The method of claim 19, wherein removing the card utilizing the card rollers comprises manually operating the card rollers.

* * * * *